US006672473B2

(12) United States Patent
Torniainen et al.

(10) Patent No.: US 6,672,473 B2
(45) Date of Patent: Jan. 6, 2004

(54) MICROWAVABLE FOOD CONTAINER WITH REINFORCING FLANGE AND SIDEWALL

(75) Inventors: Paul M. Torniainen, Plymouth, MN (US); Arne H. Brauner, Minnetonka, MN (US)

(73) Assignee: General Mills, Inc., Minneapolis, MN (US)

( * ) Notice: Subject to any disclaimer, the term of this patent is extended or adjusted under 35 U.S.C. 154(b) by 213 days.

(21) Appl. No.: 09/834,038

(22) Filed: Apr. 12, 2001

(65) Prior Publication Data

US 2002/0148840 A1 Oct. 17, 2002

(51) Int. Cl.[7] ..... B65D 1/34
(52) U.S. Cl. ..... 220/657
(58) Field of Search ..... 220/656–659

(56) References Cited

U.S. PATENT DOCUMENTS

| | | | | |
|---|---|---|---|---|
| 2,873,782 | A | * 2/1959 | Gunn | 220/659 |
| 3,128,903 | A | * 4/1964 | Crisci | 220/781 |
| 3,268,144 | A | * 8/1966 | Gaunt | 229/406 |
| 3,578,204 | A | * 5/1971 | Bloch et al. | 220/671 |
| 3,672,538 | A | * 6/1972 | Wiedemann | 206/519 |
| 3,684,633 | A | * 8/1972 | Haase | 428/66.7 |
| 3,965,323 | A | 6/1976 | Forker, Jr. et al. | |
| D276,114 | S | 10/1984 | Conti et al. | |
| D280,175 | S | 8/1985 | Bassett | |
| 4,542,271 | A | 9/1985 | Tanonis et al. | |
| 4,558,198 | A | 12/1985 | Levendusky et al. | |
| D289,844 | S | 5/1987 | Daenen et al. | |
| 4,689,458 | A | 8/1987 | Levendusky et al. | |
| 4,701,585 | A | 10/1987 | Stewart | |
| 4,704,510 | A | 11/1987 | Matsui | |
| 4,721,499 | A | 1/1988 | Marx et al. | |
| 4,785,968 | A | 11/1988 | Logan et al. | |
| 4,868,360 | A | 9/1989 | Duncan | |
| D305,086 | S | 12/1989 | Stewart | |
| 5,004,882 | A | 4/1991 | Nottingham et al. | |
| 5,203,491 | A | 4/1993 | Marx et al. | |
| 5,203,836 | A | 4/1993 | Brazi et al. | |
| 5,672,292 | A | 9/1997 | Villar Otero | |
| D399,702 | S | 10/1998 | Mishan | |
| 5,986,248 | A | 11/1999 | Matsuno et al. | |
| D417,367 | S | 12/1999 | Laib | |
| 6,175,105 | B1 | 1/2001 | Rubbright et al. | |

* cited by examiner

*Primary Examiner*—Joseph Man-Fu Moy
(74) *Attorney, Agent, or Firm*—Dicke, Billig & Czaja, PLLC; Timothy A. Czaja; Annette M. Frawley

(57) ABSTRACT

A thermoformed plastic food container for use in microwave heating. The container includes a bottom, a sidewall and a flange. The sidewall extends upwardly from the bottom, terminating at a top end. The flange extends from the sidewall opposite the bottom and includes a rim section and a return section. The rim section extends radially outwardly from the top end of the sidewall, and is curved in transverse cross-section. With this configuration, the rim section defines a radius in transverse cross-section. Further, an outer surface of the rim section is configured to receive a sealing film. Additionally, the rim section defines, in top plan view, at least one side that is longitudinally curved, preferably forming a convex curve relative to a central axis of the container. The return section extends from the rim section opposite the top end. More particularly, the return section extends generally downwardly relative to the rim section. The compound curve configuration of the flange resists deflection in response to a lifting force imparted at a single point on the flange. Thus, during use whereby a food item is contained with the container and heated, the container will not overtly deflect when a user lifts the container with a single hand.

25 Claims, 4 Drawing Sheets

MICROWAVABLE FOOD CONTAINER WITH REINFORCING FLANGE AND SIDEWALL

BACKGROUND OF THE INVENTION

The present invention relates to a container for microwave heating applications. More particularly, it relates to a thermoformed plastic food container or tray designed to resist overt torsional deflection when lifted by a user.

A wide variety of packaged, pre-made food items are sold to consumers. One particularly popular product type is pre-made food products that are served hot, and thus require heating by the consumer. Well known examples include lasagna, cheese macaroni dishes, and vegetable casseroles, to name but a few. These food items are sold to consumers in either a frozen or un-frozen state. Regardless, the food item must be heated prior to serving, such as by a conventional oven, a microwave oven, or boiling water.

In response to consumer demands for product handling convenience, pre-made heatable food products are commonly packaged and sold in useable trays or containers. From the manufacturer's standpoint, these containers are not only aesthetically pleasing, but also promote stacking of multiple items and thus compact shipping and display. Consumers, on the other hand, require that the container be amenable to use within a conventional or microwave oven such that following removal of any extraneous packing materials, the container (and contained food item) can be placed directly within an oven and then heated as required.

As with any other product, consumers also require that the cost of pre-made food products be as low as possible. So as to satisfy this overriding goal, manufacturers make every effort to optimize material and manufacturing costs, including the costs of the useable container. To this end, the heatable containers used as packaging for pre-made food items are typically thermoformed plastic, as this technique is relatively inexpensive, and promotes rapid mass production. Over time, a "standard" thermoformed plastic container design for packaged, pre-made food items has been developed. The container has a bottom and a continuous sidewall extending upwardly from the bottom. To facilitate uniform plastic flow during formation, the sidewall defines a small flange or return at a top end thereof (i.e., opposite the base). To minimize material costs, the flange is quite small, normally less than 0.125 inch in radial extension. Further, for ease of manufacture, the flange either extends only radially (relative to the sidewall), or has a single, uniform radius (such as with a rolled lip design). In this regard, a downward extension of the flange relative to the sidewall is also quite small, normally less than 0.125 inch. Of course, the size and shape of the container may vary greatly, and other features, such as handles, may be added. However, the basic design described above is universally applied.

Thermoformed plastic containers are highly viable in that they do not overly deteriorate when subjected to heat or microwaves. Unfortunately, certain potential drawbacks have been identified. For example, following heating in a microwave, the plastic container becomes less rigid. When a consumer uses two hands to lift the container by opposing sides thereof, the reduction in rigidity is of little concern. That is to say, a center of gravity of the contained food item is approximately located between the user's hands (i.e., the food item is substantially centered relative to the container), so that a force generated by a mass of the food item upon lifting thereof is uniformly dispersed along the container. An all too common practice, however, is for the consumer to lift the container with one hand, grasping the container at a corner or single point. With this approach, as the container is lifted, the center of gravity of the contained food item is offset from the support provided by the user's single hand. The force generated by the mass of the food item imparts a torque on the container, focused on the location of the user's hand. Because the now heated plastic is less rigid, the container will relatively easily deflect or bend at the user's hand, potentially causing the food item to fall out of the container. This is obviously highly undesirable. Further, due to the limited size of the flange, it is normally hot (via heat transfer from the sidewall. A user inadvertently grasping the heat container at the flange may experience discomfort or even burns.

Consumers continue to demand pre-made, heatable food items packaged in useable containers. Unfortunately, the standard thermoformed plastic container design useful for these applications does not account for torsional forces often encountered during handling following heating. Therefore, a substantial need exists for a thermoformed plastic heating container configured to resist deflection or bending when subjected to an off-center lifting force, such as when a user lifts the container with a single hand.

SUMMARY OF THE INVENTION

One aspect of the present invention relates to a thermoformed plastic food container for use in microwave heating. The container includes a bottom, a sidewall and a flange. The sidewall extends upwardly from the bottom, terminating at a top end. The flange extends from the sidewall opposite the bottom and includes a rim section and a return section. The rim section extends radially outwardly from the top end of the sidewall, and is curved in transverse cross-section. With this configuration, the rim section defines a radius in transverse cross-section. Further, an outer surface of the rim section is configured to receive a sealing film. Additionally, the rim section defines, in top plan view, at least one side that is longitudinally curved, preferably forming a convex curve relative to a central axis of the container. The return section extends from the rim section opposite the top end. More particularly, the return section extends generally downwardly relative to the rim section. The compound curve configuration of the flange resists deflection in response to a lifting force imparted at a single point of the flange. Thus, during use whereby a food item is contained with the container and heated, the container will not overtly deflect when a user lifts the container with a single hand.

Another aspect of the present invention relates to a thermoformed plastic food container for use in microwave heating. The container includes a bottom, a sidewall and a flange. The sidewall extends from the bottom and terminates in a top end opposite the bottom. More particularly, the sidewall includes a base section and an intermediate section. The base section extends radially outwardly from the bottom, and is curved in transverse cross-section. The intermediate section extends upwardly form the base section, and is curved in longitudinal cross-section. Finally, the flange extends from the top end of the sidewall. With this configuration, the compound curve configuration of the sidewall resists deflection in response to a lifting force imparted at a single point on the flange. Thus, during use whereby a food item is contained with the container and heated, the container will not overtly deflect when a user lifts the container with a single hand.

Yet another aspect of the present invention relates to a thermoformed plastic food container for use in microwave heating. The container includes a bottom, a sidewall and a flange. The sidewall extends from the bottom and terminates in a top end opposite the bottom. More particularly, the sidewall includes a base section and an intermediate section. The base section extends radially outwardly from the bottom, and is curved in transverse cross-section. The intermediate section extends upwardly form the base section, and is curved in longitudinal cross-section. The flange extends from the sidewall opposite the bottom and includes a rim section and a return section. The rim section extends radially outwardly from the top end of the sidewall, and is curved in transverse cross-section. With this configuration, the rim section defines a radius in transverse cross-section. Further, an outer surface of the rim section is configured to receive a sealing film. Additionally, the rim section forms, in top plan view, a longitudinally curved side. The return section extends from the rim section opposite the top end. The compound curve configuration of the flange and the sidewall resists deflection in response to a lifting force imparted at a single point of the flange. Thus, during use whereby a food item is contained with the container and heated, the container will not overtly deflect when a user lifts the container with a single hand.

DESCRIPTION OF THE PREFERRED EMBODIMENTS

Figure 1:
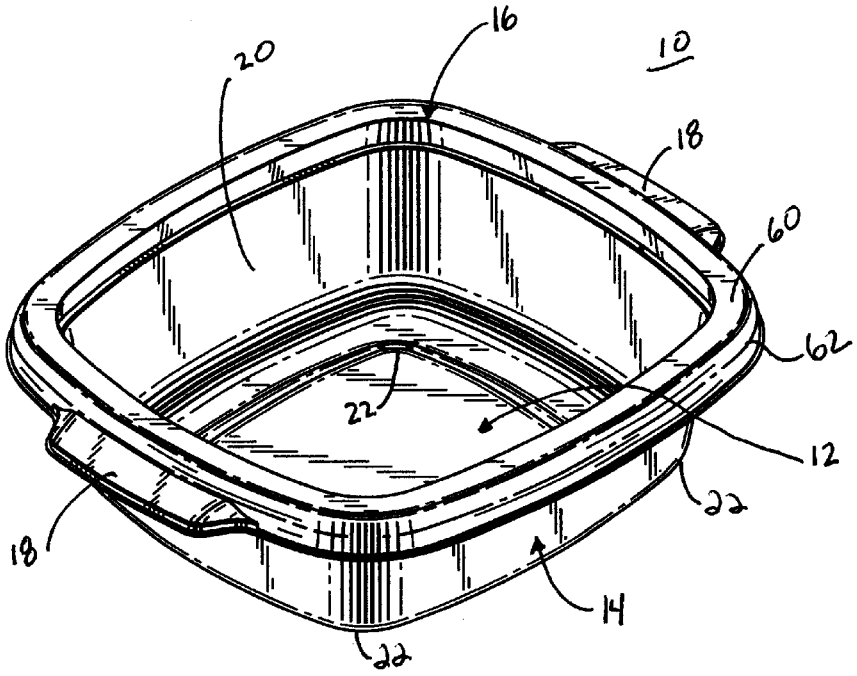
FIG. 1 is a top, perspective view of a thermoformed plastic food container in accordance with the present invention.

One preferred embodiment of a heatable food container 10 in accordance with the present invention is provided in FIG. 1. The container 10 is generally defined by a bottom 12, a sidewall 14, a flange 16 and handles 18. The various components are described in greater detail below. In general terms, however, the container 10 is an integrally thermoformed plastic material, such as polyolefins (e.g., polypropylene, polyethylene), blends of polyolefins, polystyrene, polyester resin-based materials, etc. The sidewall 14 extends upwardly from the bottom 12, defining a zone 20 for containing a food item (not shown). The flange 16 extends radially outwardly and downwardly relative to a top of the sidewall 14. The handles 18 extend from opposite sides of the flange 16, respectively. For reasons made clear below, the sidewall 14 and the flange 16 are uniquely configured to reinforce the container 10 such that during a lifting operation, the sidewall 14 and the flange 16 provide torsional support. The container 10 can incorporate different wall thickness, but in a preferred embodiment has a wall thickness in the range of 0.03–0.04 inch.

As used throughout this specification, directional terminology, such as "top," "bottom," "upwardly," "downwardly," "above," "below," etc. is with reference to the preferred upright orientation of the container 10 in FIG. 1. However, the container 10 can be positioned in a wide variety of different orientations, such that the directional terminology is in no way limiting.

The bottom 12 is preferably generally rectangular in shape (top plan view), defining four rounded corners 22 (three of which are identified in FIG. 1). Alternatively, a variety of other shapes are acceptable, including circular, square, etc. With the most preferred embodiment in which the bottom 12 is rectangular, the bottom 12 defines opposing longitudinal sides 24 and opposing lateral sides 26, as best shown in the top plan view of FIG. 2. The longitudinal sides 24 and lateral sides 26 are preferably curved, bowing outwardly (or convex) relative to a central axis C of the container 10.

Figure 3B:
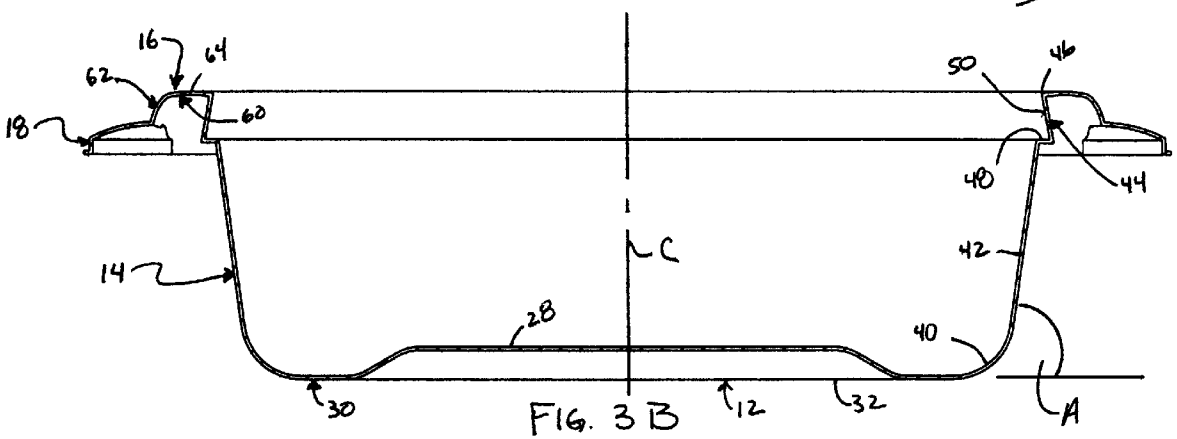
FIG. 3B is a transverse, cross-sectional view of the container of FIG. 2 along the line 3B—3B.
Figure 3A:
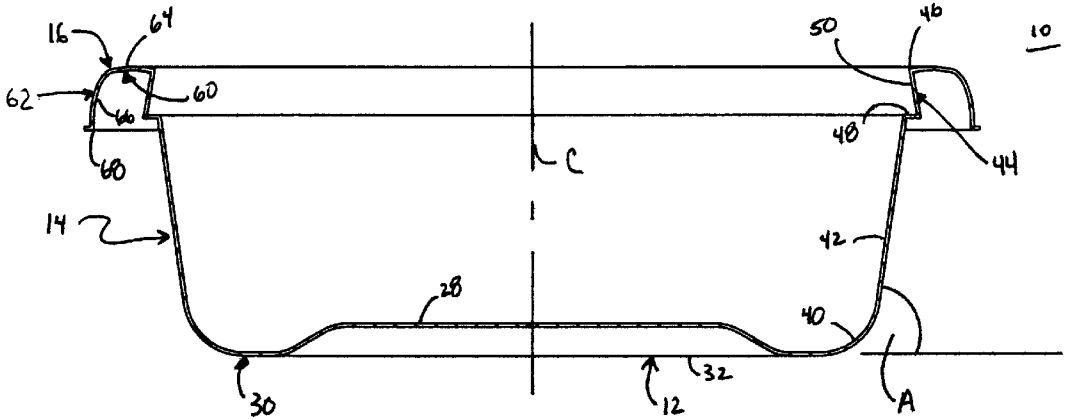
FIG. 3A is a transverse, cross-sectional view of the container of FIG. 2 along the line 3A—3A.

An additional preferred feature of the bottom 12 is illustrated in the side cross-sectional (or transverse cross-sectional) views of FIGS. 3A and 3B. A central plateau region 28 of the bottom 12 extends upwardly or inwardly relative to an outer region 30. The plateau region 28 is provided to enhance microwave interaction with food items contained within the container 10, whereas the outer region 30 defines a flat surface 32 that promotes stable placement of the container 10 on a table top or other flat surface. Thus, the outer region 30, and in particular the flat surface 32, defines a horizontal baseline plane (relative to the orientation of FIG. 3) for the container 10.

With reference to FIGS. 1, 3A and 3B, the sidewall 14 is continuous, extending from the bottom 12, and in particular the outer region 30. In this regard, the sidewall 14 is, in a preferred embodiment, defined by a base section 40, an intermediate section 42 and an upper section 44. The base section 40 extends from the bottom 12. The intermediate section 42 extends between the base and upper sections 40, 44. Finally, the upper section 40 terminates in the top end 46.

Relative to the cross-sectional views of FIGS. 3A and 3B, the base section 40 extends radially outwardly and upwardly from the bottom 12. In particular, the base section 40 is curved in transverse cross-section (or "transversely curved"). With respect to the central axis C of the container 12, the base section 40 forms a convex curve. Regardless, the base section 40 defines a transverse, cross-sectional radius in the range of 0.3–0.7 inch, more preferably in the range of 0.4–0.6 inch, most preferably approximately 0.53 inch. It has been surprisingly been found that a radius in this critical range promotes overall canister 10 stability and torsional resistance.

The intermediate section 42 extends generally upwardly from the base section 40, and is preferably linear in transverse cross-section. As shown in FIGS. 3A and 3B, however, the intermediate section 42 preferably forms a slight radially outward projection from bottom to top. Stated otherwise, the intermediate section 42 tapers inwardly (relative to the central axis C) in transverse cross-section. Thus, a transverse cross-sectional length and width of the container 10 along the intermediate section 42 is greater at a top portion thereof as compared to adjacent the base section 40. The radial projection of the intermediate section 42 defines an angle A relative to a horizontal plane (as otherwise defined by the outer region 30 of the bottom 12) in the range of 70°–89°, most preferably 82°.

Finally, the upper section 44 extends from the intermediate section 42, and defines a collar 48 and a stacking wall 50. The collar 48 extends radially outwardly from the intermediate section 42. The stacking wall 50, in turn, extends generally upwardly from the collar 48 and terminates at the top end 46. In a preferred embodiment, the stacking wall 50 defines, in transverse cross-section, a slight inward taper from bottom to top (relative to the central axis C). With this configuration, the upper section 44 promotes stacking of another, similarly formed container (not shown) within the container 10, but prevents the second container from entirely nesting within the container 10 (with the collar of the second container resting on top of the top end 46 of the sidewall 14). If the second container were allowed to fully nest within the container 10, frictional forces would prevent easy disassembly of the second container from the container 10.

Figure 4:
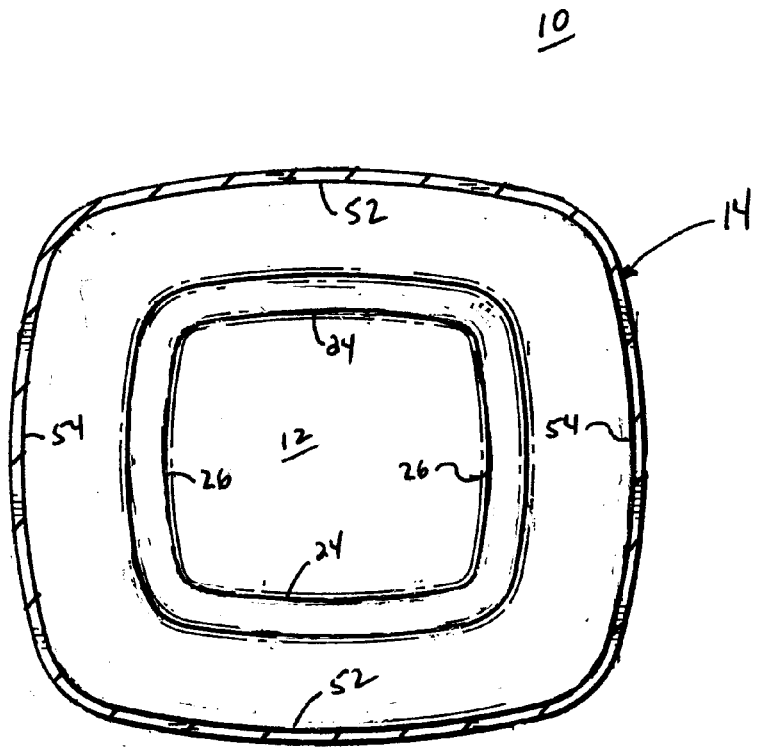
FIG. 4 is a longitudinal, cross-sectional view of the container of FIG. 1.

An additional preferred feature of the sidewall 14 is best illustrated by the longitudinal or top plan cross-sectional view of FIG. 4 (taken through the sidewall 14). There, the sidewall 14 is illustrated as preferably defining opposing longitudinal sides 52 and opposing lateral sides 54. The sides 52, 54 correspond with the sides 24, 26 of the bottom 12 previously described. As such, each of the sides 52, 54 are preferably curved, bowing outwardly (or convex) relative to the central axis C (or "longitudinally curved"). In a preferred embodiment, the longitudinal curvature of the longitudinal sides 52 defines a radius in the range of 10–12 inches, more preferably in the range of 10.5–11.5 inches, most preferably approximately 11.11 inches. Conversely, the longitudinal curvature of the lateral sides 54 defines a radius in the range of 7.5–9.5 inches, more preferably in the range of 8–9 inches, most preferably approximately 8.44 inches. It has surprisingly been found that forming the sidewall 14 to define a longitudinally curved sides within the critical ranges described enhances overall stability of the container 10.

In light of the above, the sidewall 14 defines a compound curve. More particularly, the sidewall curves both transversely (as illustrated in FIGS. 3A and 3B) and longitudinally (as illustrated in FIG. 4). This unique, compound curve configuration surprisingly enhances overall stability of the container 10, as described below.

Returning to FIG. 1, the flange 16 extends from the sidewall 14, and is generally defined by a rim section 60 and a return section 62. As best shown by the transverse cross-sectional view of FIGS. 3A and 3B, the rim section 60 extends radially outwardly from the top end 46 of the sidewall 14, providing an outer surface 64. The rim section 60 is preferably curved, defining a radius of at least 0.5 inch, more preferably in the range of 0.6–1.25 inches, even more preferably in the range of 0.7–1.00 inch, most preferably 0.85 inch. This relatively large transverse curve is in direct contrast to other available heatable food containers with flanges that are either flat or have minor curvatures (radius on the order of less than 0.25 inch). Further, the outer surface 64 has a relatively large arc length (i.e., distance between the top end 46 of the sidewall 14 and the start of the return section 62), preferably at least 0.4 inch, more preferably 0.5 inch, as compared to existing thermoformed plastic containers that have a minimal length (less than 0.25 inch) The rim section 60 of the present invention forms an relatively large radius curve for the outer surface 64, which has been surprisingly been found to more readily receive a sealing film (not shown) that is otherwise employed to seal a food item (not shown) within the container 10. Further, taken in combination with other preferred features of the flange 16, the relatively large, transverse curve of the rim section 60 within the critical parameters above enhances overall stability of the container 10.

The return section 62 extends from the rim section 60 opposite the sidewall 14. As depicted in FIGS. 3A and 3B, the return section 62 extends generally downwardly relative to the rim section 60, and generally curves relative to the sidewall 14. In one preferred embodiment, the return section 62 is defined by multiple segments 66, each having a different radius. More particularly, as the return section 62 descends from the rim section 60, each segment 66 defines an increasing larger radius, with the final segment being nearly vertical. This nearly vertical surface surprisingly facilitates removal of the container 10 from a mold cavity during manufacture. For example, in one most preferred embodiment, four segments 66 are defined, with the first segment (i.e., extending from the rim section 60) having a radius of curvature of 0.08 inch, a second segment radius of 0.32 inch, a third segment radius of 0.69 inch and a fourth segment radius of 0.96 inch. Alternatively, only a single radius need be defined by the return section 62. In the preferred embodiment, however, at least one radii defined by the return section 62 is different from that of the rim section 60, with the radius of the rim section 60 being greater than at least one radius of the return section 62. Regardless, as compared to other available heatable thermoformed plastic containers having a flange with a downwardly extending component defining a relatively small transverse radius of curvature (e.g., less than 0.125 inch), the return section 62 of the present invention defines at least one segment having a relatively large transverse radius curvature of at least 0.25 inch. The transversely curved nature of the return section 62 has surprisingly been found, within the critical parameters described, to enhance overall stability of the container 10.

The return section 62 preferably extends an appreciable distance downwardly relative to the outer surface 64 of the rim section 60. In contrast to other available designs in which downward extension of the flange is less that 0.25 inch, the return section 62 of the present invention preferably has a downward extension (relative to the outer surface 64) in the range of 0.4–0.7 inch, most preferably 0.55 inch. It is believed that this relatively large downward extension, within the critical range, surprisingly contributes to overall stability of the container 10.

Taken in combination, the flange 16 provides a relatively large spacing between the return section 62 and the sidewall 14, thereby dissipating the amount of heat transferred from the sidewall 14 to the return section 62 that might otherwise be touched by a user. In one preferred embodiment, radial extension of the rim section 60 and curvature of the return section 62 positions a trailing edge 68 of the rim section 62 approximately 0.4–0.7 inch, most preferably 0.56 inch from the sidewall 14 (relative to the transverse cross-sectional view of FIGS. 3A and 3B). Further, the flange 16 has a substantially large material length as compared to existing designs, preferably at least 0.75 inch, more preferably 1 inch, from the top end 46 of the sidewall 14 to the trailing edge 68 of the flange. It has been surprisingly been found that the combination of relatively large spacing and material length within the critical ranges described above dissipates heat transfer (conduction and radiation) from the sidewall 14 to the trailing edge 68 for a container containing a food item (not shown) heated to approximately 160 degree F. to a level at which a user can safely touch the trailing edge 68, while not overly increasing manufacturing costs.

Figure 2:
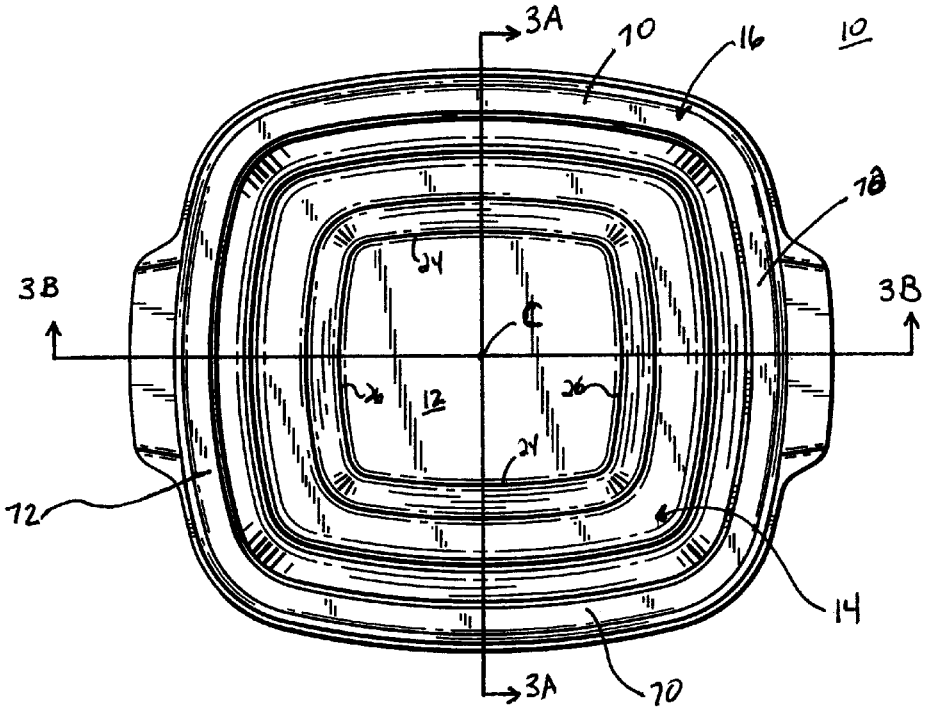
FIG. 2 is a top, plan view of the container of FIG. 1.

An additional preferred feature of the flange 16 is best illustrated by the longitudinal or top plan view of FIG. 2. There, the flange 16 is shown as preferably defining opposing longitudinal sides 70 and opposing lateral sides 72. The sides 70, 72 correspond with the sides 52, 54 of the sidewall 14 previously described. As such, each of the sides 70, 72 are preferably curved, bowing outwardly (or convex) relative to the central axis C. In a preferred embodiment, the longitudinal curvature of the longitudinal sides 70 of the flange 16 defines a radius in the range of 10–12 inches, more preferably in the range of 10.5–11.5 inches, most preferably approximately 11.11 inches. Conversely, apart from the handles 18 described below, the longitudinal curvature of the lateral sides 72 defines a radius in the range of 7.5–9.5 inches, more preferably in the range of 8–9 inches, most preferably approximately 8.44 inches. It has surprisingly been found that forming the flange 16 to define a longitudinally curved surface enhances overall stability of the container 10, especially within the critical parameters detailed above.

In light of the above, the flange 16 defines a compound curve. More particularly, the flange 16 curves in both transversely (as illustrated in FIGS. 3A and 3B) and longitudinally (as illustrated in FIG. 2). This unique, compound curve configuration greatly enhances overall stability of the container 10, as described below.

Returning to FIG. 1, and with additional reference to FIG. 3B, the handles 18 are formed as integral extensions of the flange 16. In one preferred embodiment, the handles 18 each define a radial extension from the flange 16 of approximately 0.5 inch.

In a preferred embodiment, both of the sidewall 14 and the flange 16 define compound curves as previously described. That is to say, both the sidewall 14 and the flange 16 are curved both transversely and longitudinally. This characteristic has been found to provide the container 10 with an elevated level of torque resistance when a lifting force is applied at a single point along the flange 16. Following heating, the container 10 is preferably lifted by a user (not shown) via the handles 18. In the event the user inadvertently lifts the container 10 with a single hand, grasping the flange 16 at one of the corners 22, the compound curvature nature of the sidewall 14 and the flange 16 resist deflection or bending of the container 10 due to a weight of the contained food item (not shown). For example, a container was formed according to the most preferred embodiments described above. A food item having a mass of approximately 2.5 pounds was placed within the container. The container and food item were then heated in a microwave until the food item reached a temperature of approximately 160 degree F. Immediately upon removal from the microwave, the container was lifted by a single hand at one corner of the container flange. The mass of the food item created a torque of approximately 0.9 ft-lb acting on the corner being held. The opposite corner of the container flange defected approximately 0.6875 inch from horizontal as a result of the torque. Importantly, other available, thermoformed plastic food containers such as those used to heat and contain similarly sized pasta food products or casseroles were subjected to the same conditions and were found to deflect 1.6–5.8 times greater than the container of the preferred embodiment.

Figure 5:
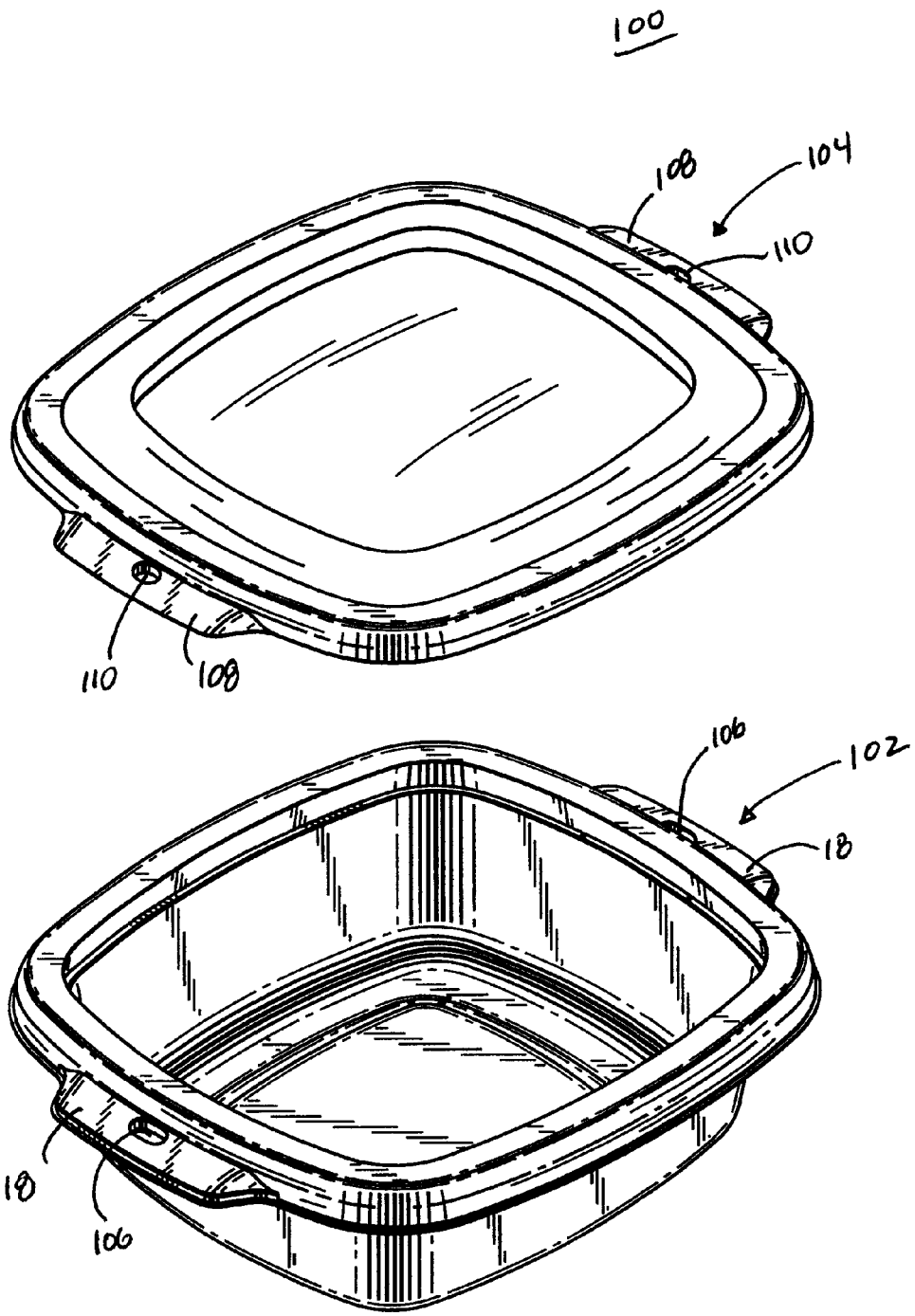
FIG. 5 is an exploded, perspective view of an alternative embodiment thermoformed plastic food container in accordance with the present invention.

An alternative embodiment container assembly 100 is illustrated in FIG. 5. The assembly includes a container 102 and a lid 104. The container 102 is identical to the container 10 (FIG. 1) previously described, except that a notch 106 is formed in each of the handles 18. The lid 104 includes handle portions 108, each having a downwardly projecting post 110 (shown partially in FIG. 5). The notches 106 are configured to selectively receive a respective one of the posts 110. With this configuration, the lid 104 is easily attached and removed from the container 102 via interaction between the respective posts 110 and notches 106.

The container of the present invention provides a marked improvement over previous designs. More particularly, the container is well suited for pre-made food packaging and heating applications, in that a thermoformed plastic is employed such that overall costs are minimized. To this end, a wide variety of food items can be contained and heated within the container, including meat products, pasta products, vegetable products, combinations of meat/pasta/vegetable, desserts, etc. Further, by forming at least one of the sidewall and the flange, preferably both, to form compound curves, the container is essentially reinforced against torsional forces possible generated when the container is lifted by a single hand following heating within an oven. This highly desirable effect is surprisingly achieved without requiring a thick plastic material, again minimizing costs.

Although the present invention has been described with reference to preferred embodiments, workers of ordinary skill will recognize that changes can be made in form and detail without departing from the spirit and scope of the present invention. For example, the most preferred embodiment forms both the sidewall and flange as compound curves. Alternatively, overall stability and torsional resistance of the container can be enhanced by forming only one of the sidewall or flange to assume the compound curve configuration. Thus, the present invention is not limited to the sidewall and flange both assuming a compound curve form.

What is claimed:

1. A thermoformed plastic food container for use in microwave heating, the container comprising:

a bottom;

a sidewall extending upwardly from the bottom and terminating at a top end; and a flange extending from the sidewall opposite the bottom, the flange including:

a rim section extending radially outwardly from the top end of the sidewall, the rim section being curved in transverse cross-section and having an outer surface configured to receive a sealing film, wherein the transverse cross-sectional curvature defines a radius of at least 0.5 inch, the rim section further defining at least one side being curved in top plan view, a return section extending from the rim section opposite the top end, the return section extending generally downwardly relative to the rim section, wherein the compound curve configuration of the flange resists deflection in response to a lifting force imparted at a single point on the flange.

2. The container of claim 1, wherein the transverse, radius defined by the rim section is in the range of 0.6–1.25 inches.

3. The container of claim 1, wherein the rim section defines, in top plan view, opposing longitudinal sides and opposing lateral sides, and further wherein each of the sides are longitudinal curves.

4. The container of claim 3, wherein a longitudinal curvature of the longitudinal sides defines a radius in the range of 10.5–11.5 inches.

5. The container of claim 4, wherein a longitudinal curvature of the lateral sides defines a radius in the range of 8–9 inches.

6. The container of claim 1, wherein the return section is curved in transverse cross-section, the curvature of the return section being different from the curvature of the rim section.

7. The container of claim 6, wherein the transverse cross-sectional radius of the rim section is greater than at least one transverse cross-sectional radius of the return section.

8. The container of claim 6, wherein the return section is comprised of multiple segments, each having different curvatures in transverse cross-section.

9. The container of claim 8, wherein the return section terminates in a trailing edge, and further wherein the segment forming the trailing edge is substantially vertical.

10. The container of claim 1, wherein the outer surface of the rim section has an arc length of at least 0.4 inch and a transverse radius of at least 0.75 inch.

11. The container of claim 1, wherein a downward extension of the return section relative to an upper most point of the rim section is in the range of 0.4–0.7 inch.

12. The container of claim 1, wherein the flange is configured such that a radial distance between a trailing edge of the return section and the sidewall is in the range of 0.4–0.7 inch.

13. The container of claim 1, wherein the sidewall includes a lower section and an upper section, the lower section extending from the bottom, and the upper section extending from the lower section and terminating at the top end, and further wherein extension of the upper section relative to the lower section defines an inward taper relative to a central axis of the container.

14. A thermoformed plastic food container for use in microwave heating, the container comprising:

a bottom;

a sidewall extending from the bottom and terminating in a top end opposite the bottom, the sidewall including:

a base section extending radially outwardly from the bottom, the base section being curved in transverse cross-section, an intermediate section extending upwardly from the base section, the intermediate section being curved in longitudinal cross-section; and a flange extending from the top end of the sidewall, the flange including:

a rim section extending radially outwardly from the top end of the sidewall, the rim section being curved in transverse cross-section and having an outer surface configured to receive a sealing film, wherein the transverse cross-sectional curvature defines a radius of at least 0.5 inch, the rim section further defining at least one side being curved in top plan view, a return section extending from the rim section opposite the top end, the return section extending generally downwardly relative to the rim section;

wherein the compound curve configuration of the sidewall and the flange resists deflection in response to a lifting force imparted at a single point along the flange.

15. The container of claim 14, wherein the intermediate section defines, in top plan view, opposing longitudinal sides and opposing lateral sides, each of the sides forming a convex curve relative to a central axis of the container.

16. The container of claim 15, wherein a longitudinal curvature of the longitudinal sides defines a radius in the range of 10.5–11.5 inches.

17. The container of claim 15, wherein a longitudinal curvature of the lateral sides defines a radius in the range of 8–9 inches.

18. The container of claim 14, wherein the transverse radius of the rim section in the range of 0.6–1.25 inches.

19. The container of claim 14, wherein the rim section defines, in top plan view, opposing longitudinal sides and opposing lateral sides, and further wherein each of the sides are longitudinal curves.

20. The container of claim 14, wherein the return section is curved in transverse cross-section, the curvature of the return section being different from the curvature of the rim section.

21. The container of claim 20, wherein the transverse cross-sectional radius of the rim section is greater than at least one transverse cross-section radius of the return section.

22. The container of claim 20, wherein the return section is comprised of multiple segments, each having different curvatures in transverse cross-section.

23. The container of claim 22, wherein the return section terminates in a trailing edge, and further wherein the segment forming the trailing edge is substantially vertical.

24. The container of claim 14, wherein the outer surface of the rim section has an arc length of at least 0.4 inch and a transverse radius of at least 0.75 inch.

25. The container of claim 14, wherein the sidewall further includes an upper section extending from the intermediate section and terminating in the top end, and further wherein extension of the upper section relative to the intermediate section defines an inward taper relative to a central axis of the container.

* * * * *